US009119267B2

(12) United States Patent
Park et al.

(10) Patent No.: US 9,119,267 B2
(45) Date of Patent: Aug. 25, 2015

(54) APPARATUS AND METHOD FOR CONTROLLING FAULT IN LIGHTING NETWORK

(71) Applicant: Electronics and Telecommunications Research Institute, Daejeon (KR)

(72) Inventors: Seong-Hee Park, Daejeon (KR); Tae-Gyu Kang, Daejeon (KR); In-Su Kim, Daejeon (KR); Sang-Kyu Lim, Daejeon (KR); You-Jin Kim, Daejeon (KR); Il-Soon Jang, Daejeon (KR); Dae-Ho Kim, Daejeon (KR); Jin-Doo Jeong, Daejeon (KR); Hyun-Jong Kim, Cheongju-si (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 341 days.

(21) Appl. No.: 13/846,877

(22) Filed: Mar. 18, 2013

(65) Prior Publication Data

US 2014/0009083 A1 Jan. 9, 2014

(30) Foreign Application Priority Data

Jul. 3, 2012 (KR) ..... 10-2012-0072347

(51) Int. Cl.

| | |
|---|---|
| ***H05B 33/08*** | (2006.01) |
| ***H05B 37/03*** | (2006.01) |
| *H05B 37/02* | (2006.01) |

(52) U.S. Cl.
CPC ..... *H05B 33/0881* (2013.01); *H05B 37/034* (2013.01); *H05B 37/0245* (2013.01)

(58) Field of Classification Search
USPC ..... 315/291, 294, 297, 312
See application file for complete search history.

(56) References Cited

U.S. PATENT DOCUMENTS

| | | | | |
|---|---|---|---|---|
| 2003/0222603 | A1* | 12/2003 | Mogilner et al. | 315/294 |
| 2004/0122930 | A1* | 6/2004 | Pasternak | 709/223 |
| 2008/0315687 | A1* | 12/2008 | Sabharwal | 307/68 |

FOREIGN PATENT DOCUMENTS

| | | | |
|---|---|---|---|
| KR | 1020050113680 | A | 12/2005 |
| KR | 100870733 | B1 | 11/2008 |

* cited by examiner

*Primary Examiner* — Douglas W Owens
*Assistant Examiner* — Thai Pham
(74) *Attorney, Agent, or Firm* — William Park & Associates Ltd.

(57) ABSTRACT

Disclosed herein is an apparatus and method for controlling a fault in a lighting network. The apparatus includes power selection units respectively provided in a plurality of lighting units connected to one another over a network, each power selection unit being configured to compare a reference voltage with an output voltage sensed from power supply signals input from power supply units respectively provided in a lighting unit, located ahead of a faulty lighting unit, and the faulty lighting unit if a fault occurs in the lighting unit, and to select supply power to be supplied to the faulty lighting unit. Lighting control units control driving of the faulty lighting unit using the selected supply power.

12 Claims, 5 Drawing Sheets

APPARATUS AND METHOD FOR CONTROLLING FAULT IN LIGHTING NETWORK

CROSS REFERENCE TO RELATED APPLICATION

This application claims the benefit of Korean Patent Application No. 10-2012-0072347, filed on Jul. 3, 2012, which is hereby incorporated by reference in its entirety into this application.

BACKGROUND OF THE INVENTION

1. Technical Field

The present invention relates generally to an apparatus and method for controlling a fault in a lighting network and, more particularly, to an apparatus and method for controlling a fault in a lighting network, which use a daisy-chain network topology based on a Recommended Standard 485 (RS485) communication scheme.

2. Description of the Related Art

Recently, the importance of the Light Emitting Diode (LED) lighting industry has gradually increased. In the past, most operations for lighting were implemented merely by turning on and off a single lighting lamp using a single switch. However, recently, such a lighting scheme has developed into a centralized scheme in which a central control unit controls a plurality of lighting devices over a network.

In order to implement such a lighting network, various types of topological structures can be used. First, RS485 communication enables a topology to be configured in a bus manner and enables a plurality of devices to be simultaneously connected to the bus, so that one-to-many communication or many-to-many communication can be realized. Such a structure is widely used in lighting networks at the present time.

In detail, bus structures that can be implemented using an RS485 communication scheme include a tree bus structure, a star structure, or a daisy-chain bus structure.

First, the tree bus structure is characterized in that the current of signals can be weakened while data transmitted from a lighting control device is reaching a lighting device in a final stage, so that an effective range of 1.2 km of the RS485 communication scheme may not be guaranteed. Therefore, such a tree bus structure is useful for the control of a small number of lighting devices, but causes a problem in connecting and operating a plurality of lighting devices in conjunction with one another.

Next, the daisy-chain bus structure can be configured such that data transmitted from a lighting control apparatus disclosed in Korean Patent No. 100870733 (Date of registration: Nov. 20, 2008) entitled "Remote lighting control apparatus and method," is connected to a neighboring lighting device, and that lighting device is connected to its neighboring lighting device, so that the individual lighting devices can be connected in series. Such a daisy-chain bus structure is advantageous in that the loss of current is low and the influence of noise is less, and in that the length of a cable can be reduced because the individual lighting devices are connected in series. However, such a daisy-chain bus structure is problematic in that when a fault occurs in a single lighting device, none of the lighting devices may be normally operated.

SUMMARY OF THE INVENTION

Accordingly, the present invention has been made keeping in mind the above problems occurring in the prior art, and an object of the present invention is to provide an apparatus and method for controlling a fault in a lighting network, in which neighboring lighting units can normally transmit lighting control data without being influenced by a faulty lighting unit even if a fault occurs in one of a plurality of lighting units based on the lighting network.

In accordance with an aspect of the present invention to accomplish the above object, there is provided an apparatus for controlling a fault in a lighting network, including power selection units respectively provided in a plurality of lighting units connected to one another over a network, each power selection unit being configured to compare a reference voltage with an output voltage sensed from power supply signals input from power supply units respectively provided in a lighting unit located ahead of a faulty lighting unit and in the faulty lighting unit if a fault occurs in the lighting unit, and to select supply power to be supplied to the faulty lighting unit; and lighting control units for controlling driving of the faulty lighting unit using the selected supply power.

Preferably, each of the lighting control units may include a first transceiver unit for receiving a differential signal required to control the plurality of lighting units from a lighting central management unit and converting the differential signal into a digital signal; a lighting control logic unit for receiving the differential signal converted into the digital signal, and then generating a lighting control signal; a second transceiver unit for re-converting the lighting control signal generated from the digital signal into a differential signal, and transmitting the differential signal to a lighting unit located behind the faulty lighting unit; and a lighting drive unit for receiving the lighting control signal, and then driving the corresponding lighting unit.

Preferably, the lighting control logic unit may include a data detection block for buffering the differential signal converted into the digital signal and detecting lighting control data; a data generation block for generating only usage data to be used for the faulty lighting unit from the detected lighting control data; a lighting control signal generation block for generating a lighting control signal required for lighting control from the usage data; a data storage block for storing the usage data; and a timing generation block for controlling generation and synchronization of a clock signal used for the above blocks.

Preferably, the power selection unit may be configured to, if an output voltage input from a lighting control unit provided in a lighting unit located ahead of the faulty lighting unit or an output voltage input from the power supply unit is less than a preset reference voltage, select power input from the lighting unit located ahead of the faulty lighting unit as supply power.

Preferably, the power selection unit may be configured to, if an output voltage input from a lighting control unit provided in a lighting unit located ahead of the faulty lighting unit or an output voltage input from the power supply unit is greater than a preset reference voltage, re-compare the output voltage input from the lighting control unit provided in the lighting unit located ahead of the faulty lighting unit with the reference voltage.

Preferably, upon performing the re-comparison, if the reference voltage is greater than the output voltage input from the lighting control unit provided in the lighting unit located ahead of the faulty lighting unit, the power input from the lighting unit located ahead of the faulty lighting unit may be selected as the supply power.

Preferably, upon performing the re-comparison, if the reference voltage is less than the output voltage input from the lighting control unit provided in the lighting unit located ahead of the faulty lighting unit, power input from a charging unit for providing a charging voltage to the power supply unit may be selected as the supply power.

In accordance with another aspect of the present invention to accomplish the above object, there is provided a method of controlling a fault in a lighting network, including determining, by power selection units respectively provided in a plurality of lighting units connected to one another over a network, whether a fault has occurred in the lighting units; if it is determined that the fault has occurred, receiving power supply signals respectively input from power supply units provided in a lighting unit located ahead of a faulty lighting unit and in the faulty lighting unit; sensing an output voltage from the received power supply signals and comparing the output voltage with a reference voltage; selecting supply power to be supplied to the faulty lighting unit based on results of the comparison; and controlling, by a lighting control unit, driving of the faulty lighting unit using the selected supply power.

Preferably, the method may further include, after the sensing the output voltage from the received power supply signals and comparing the output voltage with the reference voltage, if an output voltage input from the lighting control unit provided in the lighting unit located ahead of the faulty lighting unit or an output voltage input from the power supply unit is greater than a preset reference voltage, re-comparing the output voltage input from the lighting control unit provided in the lighting unit located ahead of the faulty lighting unit with the reference voltage.

Preferably, after the re-comparing the output voltage input from the lighting control unit provided in the lighting unit located ahead of the faulty lighting unit with the reference voltage, if the reference voltage is greater than the output voltage input from the lighting control unit provided in the lighting unit located ahead of the faulty lighting unit upon performing the re-comparison, the power input from the lighting unit located ahead of the faulty lighting unit may be used as the supply power to be supplied to the faulty lighting unit at the selecting the supply power.

Preferably, after the re-comparing the output voltage input from the lighting control unit provided in the lighting unit located ahead of the faulty lighting unit with the reference voltage, if the reference voltage is less than the output voltage input from the lighting control unit provided in the lighting unit located ahead of the faulty lighting unit upon performing the re-comparison, power input from a charging unit for supplying a charging voltage to the power supply unit may be used as the supply power to be supplied to the faulty lighting unit at the selecting the supply power.

Preferably, the selecting the supply power to be supplied to the faulty lighting unit based on the results of comparison may be configured to, if as the results of the comparison, an output voltage input from the lighting control unit provided in the lighting unit located ahead of the faulty lighting unit or an output voltage input from the power supply unit is less than a preset reference voltage, use power output from the lighting unit located ahead of the faulty lighting unit as the supply power to be supplied to the faulty lighting unit.

The apparatus and method for controlling a fault in a lighting network according to the present invention, having the above configuration, are advantageous in that lighting control data is normally transmitted using a power supply method so that, even if a fault occurs in one of a plurality of lighting units based on a lighting network, lighting units neighboring a faulty lighting unit are not influenced by the faulty lighting unit, thus actively controlling lighting network communication.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Figure 1:
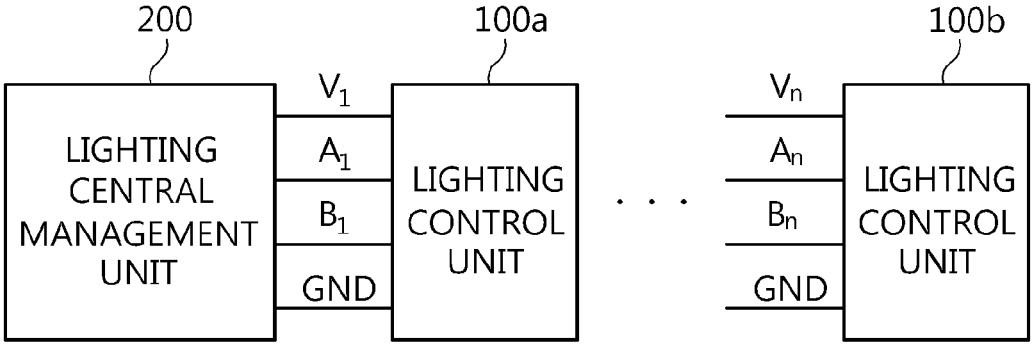
FIG. 1 is a diagram showing the configuration of an apparatus for controlling a fault in a lighting network according to an embodiment of the present invention.

Preferred embodiments of the present invention will be described in detail below with reference to the accompanying drawings to such an extent that those skilled in the art can easily implement the technical spirit of the present invention. Reference now should be made to the drawings, in which the same reference numerals are used throughout the different drawings to designate the same or similar components. In the following description, redundant descriptions and detailed descriptions of known elements or functions that may unnecessarily make the gist of the present invention obscure will be omitted.

Hereinafter, an apparatus and method for controlling a fault in a lighting network according to embodiments of the present invention will be described in detail with reference to the attached drawings.

Figure 2:
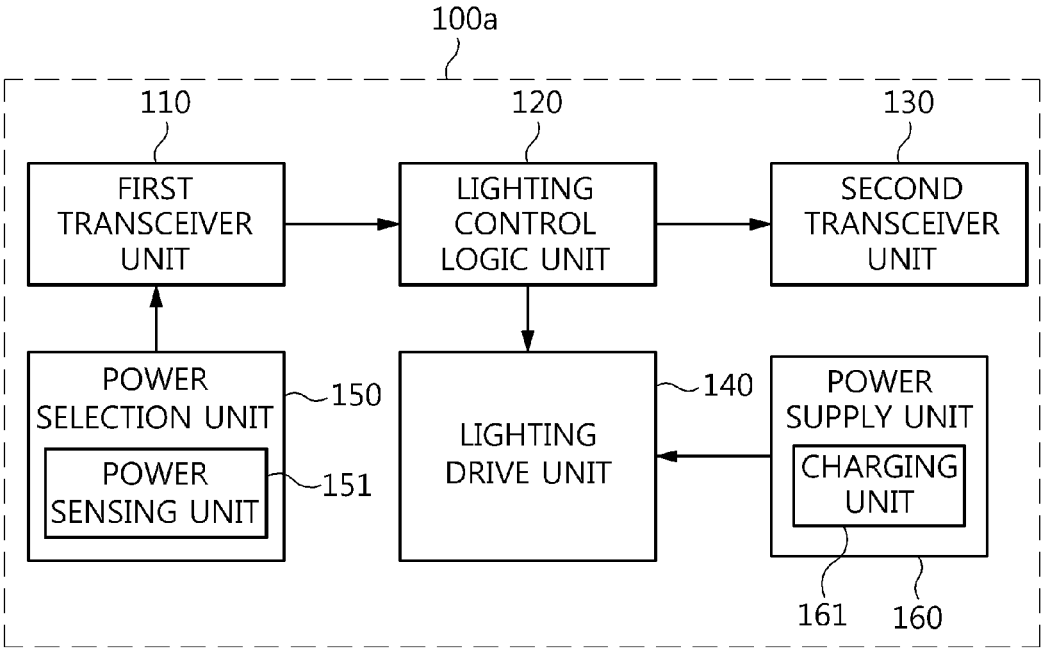
FIG. 2 is a block diagram showing the detailed configuration of a lighting control unit employed in the apparatus for controlling a fault in a lighting network according to an embodiment of the present invention.
Figure 3:
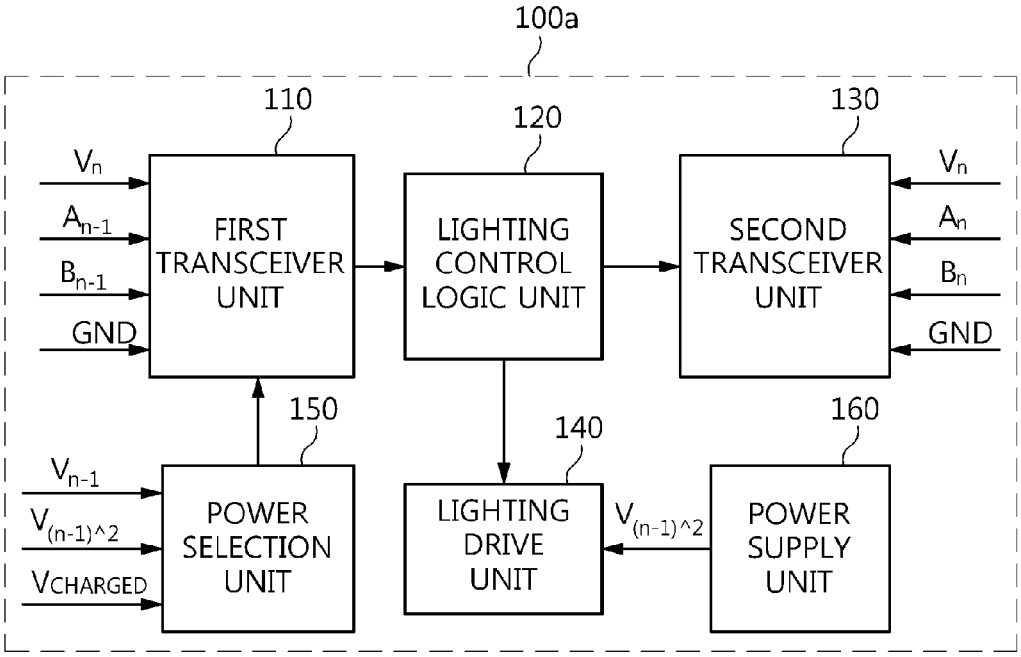
FIG. 3 is a diagram showing the flow of differential signals and power supply signals in the apparatus for controlling a fault in a lighting network according to an embodiment of the present invention.
Figure 4:
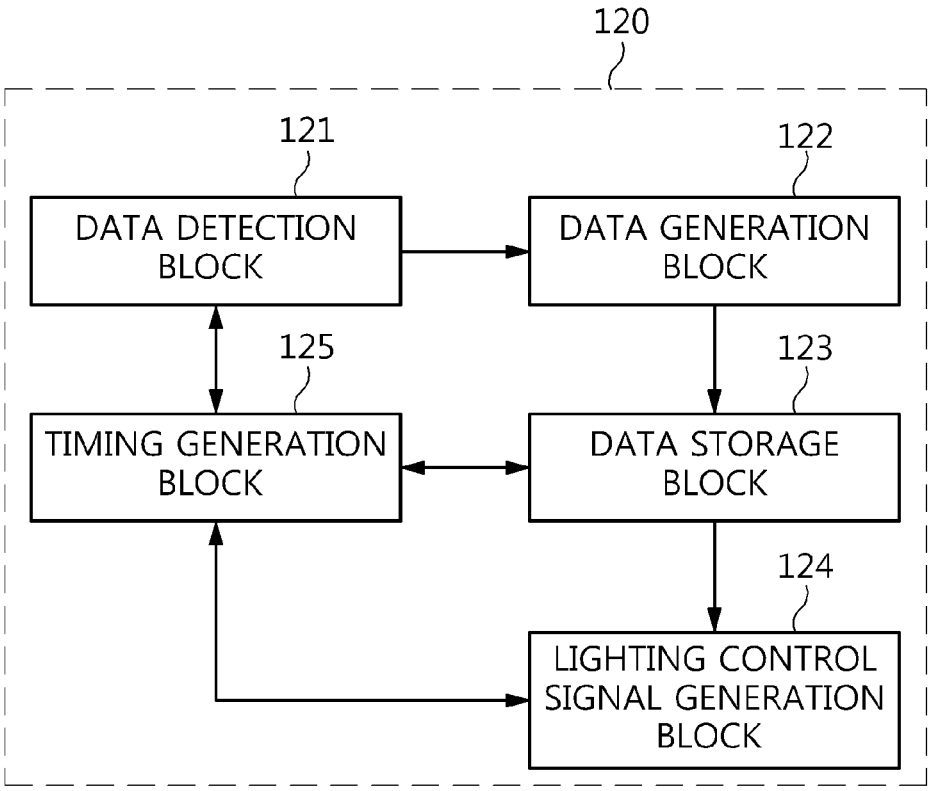
FIG. 4 is a block diagram showing the detailed configuration of a lighting control logic unit employed in the lighting control unit according to an embodiment of the present invention.

FIG. 1 is a diagram showing the configuration of an apparatus for controlling a fault in a lighting network according to an embodiment of the present invention, FIG. 2 is a block diagram showing the detailed configuration of a lighting control unit employed in the apparatus for controlling a fault in a lighting network according to an embodiment of the present invention, FIG. 3 is a diagram showing the flow of differential signals and power supply signals in the apparatus for controlling a fault in a lighting network according to an embodiment of the present invention, and FIG. 4 is a block diagram showing the detailed configuration of a lighting control logic unit employed in the lighting control unit according to an embodiment of the present invention.

Referring to FIG. 1, an apparatus 100 for controlling a fault in a lighting network according to the present invention may mainly include lighting control units 100*a* to 100*b* and a lighting central management unit 200.

The lighting central management unit 200 outputs differential signals required to control a plurality of lighting units connected over a network. That is, the lighting central management unit 200 transmits a control signal required to control the lighting units as a differential signal $A_1$-$B_1$ to the lighting control unit 100*a*, and this differential signal is sequentially transferred to the lighting control unit 100*b* located at the end of the apparatus. Here, the differential signal is indicated by $A_1$-$B_1$, $A_2$-$B_2$, $A_3$-$B_3$, $A_{n-1}$-$B_{n-1}$, and $A_n$-$B_n$ in the drawing.

The lighting control units 100*a* to 100*b* are respectively provided in the plurality of lighting units and are configured to control the driving of a faulty lighting unit based on a differential signal and an externally input power supply signal when a fault occurs in the corresponding lighting unit. The power supply signal is $V_n$, which is indicated by $V_1$, $V_2$, $V_3$, $V_{n-1}$, $V_n$, and GND. Here, GND is a signal connected in common to the lighting central management unit 200 and all of the lighting control units 100*a* to 100*b*.

For this, as shown in FIGS. 2 and 3, each of the lighting control units 100*a* to 100*b* includes a first transceiver unit 110, a lighting control logic unit 120, a second transceiver unit 130, a lighting drive unit 140, a power selection unit 150, and a power supply unit 160.

The first transceiver unit 110 converts an input differential signal into a digital signal. In this case, the first transceiver unit 110 receives a differential signal $A_{n-1}$ and $B_{n-1}$ from the lighting central management unit 200, converts the differential signal into a digital signal, and receives power supply signals $V_n$ and GND from the outside of the lighting control unit.

The lighting control logic unit 120 receives the differential signal converted into the digital signal, and then generates a lighting control signal. For this, as shown in FIG. 4, the lighting control logic unit 120 includes a data detection block 121 for buffering the differential signal converted into the digital signal and detecting lighting control data, a data generation block 122 for generating only usage data that is used for a faulty lighting unit from the detected lighting control data, a lighting control signal generation block 124 for generating a lighting control signal required for lighting control from the usage data, a data storage block 123 for storing the usage data, and a timing generation block 125 for controlling the generation and synchronization of a clock signal used for the above components.

The second transceiver unit 130 reconverts the lighting control signal, generated from the digital signal, into a differential signal, and transmits the differential signal to a lighting unit located behind a faulty lighting unit.

The lighting drive unit 140 receives the lighting control signal and drives the corresponding lighting unit.

The power selection unit 150 senses an output voltage via a power sensing unit 151 from power supply signals respectively received from the lighting control unit 100*a* provided in a lighting unit located ahead of a faulty lighting unit and the power supply unit 160 provided in the faulty lighting unit, compares the sensed output voltage with a reference voltage, and selects whether to use power input from the lighting central management unit 200 or power input from the lighting unit located ahead of the faulty lighting unit as power to be supplied to the faulty lighting unit.

That is, if an output voltage $V_{n-1}$ input from the lighting control unit 100*a* to 100*b* provided in a lighting unit located ahead of the faulty lighting unit or an output voltage $V_{(n-1)\hat{}2}$ input from the power supply unit 160 is less than a preset reference voltage, the power selection unit 150 selects and uses the voltage, output from the lighting control unit 100*a* to 100*b* provided in the lighting unit located ahead of the faulty lighting unit, as the power to be supplied to the faulty lighting unit.

In contrast, if the output voltage input from the lighting control unit 100*a* to 100*b* provided in the lighting unit located ahead of the faulty lighting unit or the output voltage input from the power supply unit 160 is greater than the preset reference voltage, the power selection unit 150 re-compares the output voltage input from the lighting control unit 100*a* to 100*b* provided in the lighting unit located ahead of the faulty lighting unit with the reference voltage. In this case, if the preset reference voltage is greater than the output voltage input from the lighting control unit 100*a* to 100*b* provided in the lighting unit located ahead of the faulty lighting unit, the voltage output from the lighting control unit 100*a* to 100*b* provided in the lighting unit located ahead of the faulty lighting unit is selected as the power to be supplied to the faulty lighting unit. If the preset reference voltage is less than the output voltage input from the lighting control unit 100*a* to 100*b* provided in the lighting unit located ahead of the faulty lighting unit, a voltage of $V_{(n-1)\hat{}2}$ output from a charging unit 161 is selected and used as the power to be supplied to the faulty lighting unit.

The power supply unit 160 is a main power source for supplying sufficient power required to drive the corresponding lighting unit, and is provided with the charging unit 161 as an emergency power source. In this case, the charging unit 161 provides a charging voltage to the power supply unit 160 in preparation for the case where a fault occurs in two or more lighting control units 100*a* to 100*b*.

Figure 5:
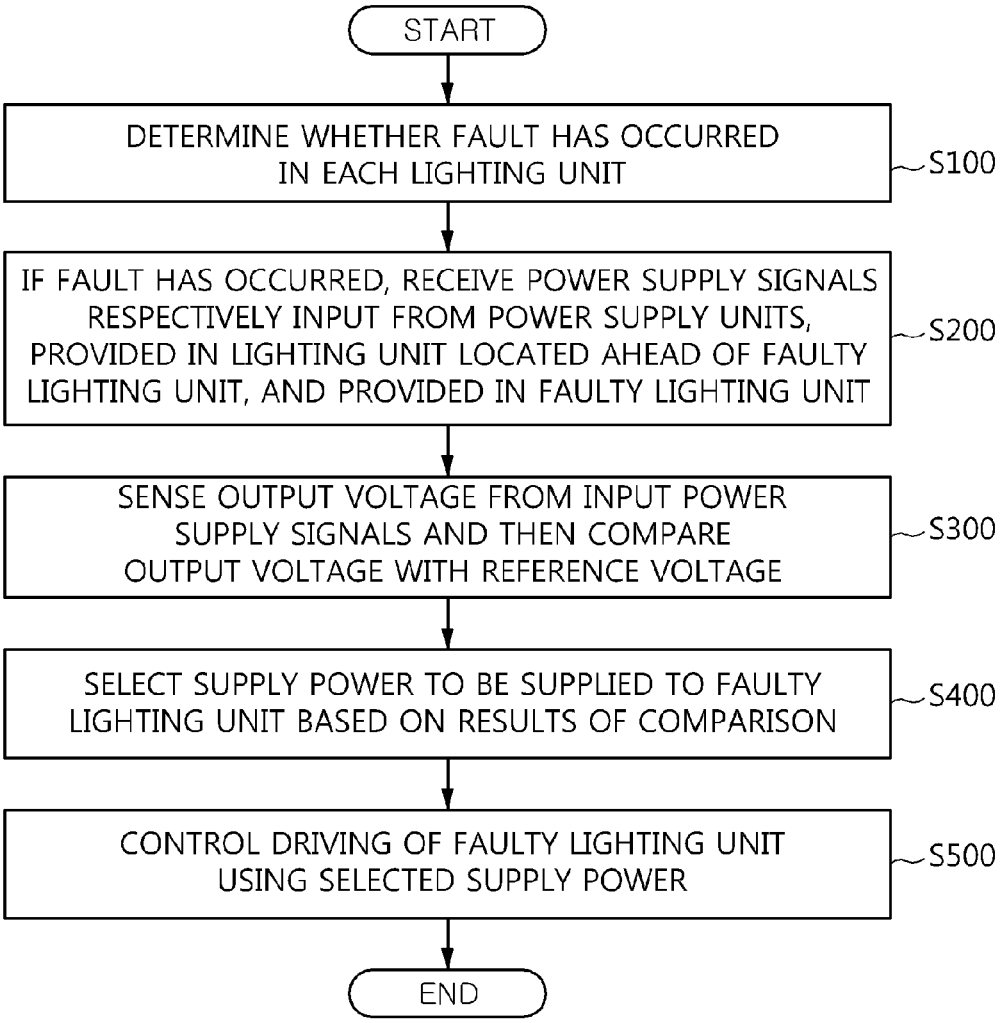
FIG. 5 is a flowchart showing a method of controlling a fault in a lighting network according to an embodiment of the present invention.

FIG. 5 is a flowchart showing a method of controlling a fault in a lighting network according to an embodiment of the present invention.

Referring to FIG. 5, in the method of controlling a fault in a lighting network according to the present invention, each of power selection units respectively provided in a plurality of lighting units connected to one another over a network determines whether a fault has occurred in the corresponding lighting unit at step S100.

If it is determined that a fault has occurred, power supply signals respectively input from a power supply unit provided in a lighting unit located ahead of a faulty lighting unit, and a power supply unit provided in the faulty lighting unit are received at step S200.

Next, an output voltage is sensed from the input power supply signals and is then compared with a reference voltage at step S300.

Next, based on the results of the comparison, supply power to be supplied to the faulty lighting unit is selected at step S400. Based on the results of the comparison, if the output voltage input from the lighting control unit 100*a* to 100*b* provided in the lighting unit located ahead of the faulty lighting unit or the output voltage input from the power supply unit 160 is less than the preset reference voltage, the voltage output from the lighting control unit 100*a* to 100*b* provided in the lighting unit located ahead of the faulty lighting unit is selected and used as the power to be supplied to the faulty lighting unit. In contrast, at the comparison step, if the output voltage input from the lighting control unit 100*a* to 100*b* provided in the lighting unit located ahead of the faulty lighting unit or the output voltage input from the power supply unit 160 is greater than the preset reference voltage, the output voltage input from the lighting control unit 100*a* to 100*b* provided in the lighting unit located ahead of the faulty lighting unit is re-compared with the reference voltage. In this case, upon performing the re-comparison, if the reference voltage is greater than the output voltage input from the lighting control unit 100*a* to 100*b* provided in the lighting unit located ahead of the faulty lighting unit, the voltage output from the lighting control unit 100*a* to 100*b* provided in the lighting unit located ahead of the faulty lighting unit is selected and used as the power to be supplied to the faulty lighting unit at the power selection step. Further, upon performing the re-comparison, if the reference voltage is less than the output voltage input from the lighting control unit 100*a* to 100*b* provided in the lighting unit located ahead of the faulty lighting unit, the voltage output from the charging unit 161 that provides the charging voltage to the power supply unit is selected and used as the power to be supplied to the faulty lighting unit at the power selection step.

Next, the lighting control unit controls the driving of the faulty lighting unit using the selected supply power at step S500.

In this way, the present invention normally transmits lighting control data using a power supply method so that, even if a fault occurs in one of a plurality of lighting units based on a lighting network, lighting units neighboring a faulty lighting unit are not influenced by the faulty lighting unit, thus actively controlling lighting network communication.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An apparatus for controlling a fault in a lighting network, comprising:

power selection units respectively provided in a plurality of lighting units connected to one another over a network, each power selection unit being configured to compare a reference voltage with an output voltage sensed from power supply signals input from power supply units respectively provided in a lighting unit located ahead of a faulty lighting unit and in the faulty lighting unit if a fault occurs in the lighting unit, and to select supply power to be supplied to the faulty lighting unit; and lighting control units for controlling driving of the faulty lighting unit using the selected supply power.

2. The apparatus of claim 1, wherein each of the lighting control units comprises:

a first transceiver unit for receiving a differential signal required to control the plurality of lighting units from a lighting central management unit and converting the differential signal into a digital signal;

a lighting control logic unit for receiving the differential signal converted into the digital signal, and then generating a lighting control signal;

a second transceiver unit for re-converting the lighting control signal generated from the digital signal into a differential signal, and transmitting the differential signal to a lighting unit located behind the faulty lighting unit; and a lighting drive unit for receiving the lighting control signal, and then driving the corresponding lighting unit.

3. The apparatus of claim 2, wherein the lighting control logic unit comprises:

a data detection block for buffering the differential signal converted into the digital signal and detecting lighting control data;

a data generation block for generating only usage data to be used for the faulty lighting unit from the detected lighting control data;

a lighting control signal generation block for generating a lighting control signal required for lighting control from the usage data;

a data storage block for storing the usage data; and a timing generation block for controlling generation and synchronization of a clock signal used for the above blocks.

4. The apparatus of claim 1, wherein the power selection unit is configured to, if an output voltage input from a lighting control unit provided in a lighting unit located ahead of the faulty lighting unit or an output voltage input from the power supply unit is less than a preset reference voltage, select power input from the lighting unit located ahead of the faulty lighting unit as supply power.

5. The apparatus of claim 1, wherein the power selection unit is configured to, if an output voltage input from a lighting control unit provided in a lighting unit located ahead of the faulty lighting unit or an output voltage input from the power supply unit is greater than a preset reference voltage, re-compare the output voltage input from the lighting control unit provided in the lighting unit located ahead of the faulty lighting unit with the reference voltage.

6. The apparatus of claim 5, wherein upon performing the re-comparison, if the reference voltage is greater than the output voltage input from the lighting control unit provided in the lighting unit located ahead of the faulty lighting unit, the power input from the lighting unit located ahead of the faulty lighting unit is selected as the supply power.

7. The apparatus of claim 5, wherein upon performing the re-comparison, if the reference voltage is less than the output voltage input from the lighting control unit provided in the lighting unit located ahead of the faulty lighting unit, power input from a charging unit for providing a charging voltage to the power supply unit is selected as the supply power.

8. A method of controlling a fault in a lighting network, comprising:

determining, by power selection units respectively provided in a plurality of lighting units connected to one another over a network, whether a fault has occurred in the lighting units;

if it is determined that the fault has occurred, receiving power supply signals respectively input from power supply units provided in a lighting unit located ahead of a faulty lighting unit and in the faulty lighting unit;

sensing an output voltage from the received power supply signals and comparing the output voltage with a reference voltage;

selecting supply power to be supplied to the faulty lighting unit based on results of the comparison; and controlling, by a lighting control unit, driving of the faulty lighting unit using the selected supply power.

9. The method of claim 8, further comprising, after the sensing the output voltage from the received power supply signals and comparing the output voltage with the reference voltage, if an output voltage input from the lighting control unit provided in the lighting unit located ahead of the faulty lighting unit or an output voltage input from the power supply unit is greater than a preset reference voltage, re-comparing the output voltage input from the lighting control unit provided in the lighting unit located ahead of the faulty lighting unit with the reference voltage.

10. The method of claim 9, wherein after the re-comparing the output voltage input from the lighting control unit provided in the lighting unit located ahead of the faulty lighting unit with the reference voltage, if the reference voltage is greater than the output voltage input from the lighting control unit provided in the lighting unit located ahead of the faulty lighting unit upon performing the re-comparison, the power input from the lighting unit located ahead of the faulty lighting unit is used as the supply power to be supplied to the faulty lighting unit at the selecting the supply power.

11. The method of claim 9, wherein after the re-comparing the output voltage input from the lighting control unit provided in the lighting unit located ahead of the faulty lighting unit with the reference voltage, if the reference voltage is less than the output voltage input from the lighting control unit provided in the lighting unit located ahead of the faulty lighting unit upon performing the re-comparison, power input from a charging unit for supplying a charging voltage to the power supply unit is used as the supply power to be supplied to the faulty lighting unit at the selecting the supply power.

12. The method of claim 8, wherein the selecting the supply power to be supplied to the faulty lighting unit based on the results of comparison is configured to, if as the results of the comparison, an output voltage input from the lighting control unit provided in the lighting unit located ahead of the faulty lighting unit or an output voltage input from the power supply unit is less than a preset reference voltage, use power output from the lighting unit located ahead of the faulty lighting unit as the supply power to be supplied to the faulty lighting unit.

* * * * *